United States Patent [19]

Duffy

[11] 4,238,944

[45] Dec. 16, 1980

[54] ROLLING OF STEPPED SHAFTS

[76] Inventor: James C. Duffy, South Euclid, Ohio

[21] Appl. No.: 2,676

[22] Filed: Jan. 11, 1979

[51] Int. Cl.[3] ..... B21H 1/18

[52] U.S. Cl. ..... 72/84; 72/107; 72/110

[58] Field of Search ..... 72/84, 107, 110, 111

[56] References Cited

U.S. PATENT DOCUMENTS

| | | | |
|---|---|---|---|
| 503,616 | 8/1893 | Peacock | 72/110 |
| 559,230 | 4/1896 | Weber | 72/107 |
| 1,301,221 | 4/1919 | Brinkman | 72/84 |

*Primary Examiner*—Lowell A. Larson

*Attorney, Agent, or Firm*—Burge & Porter Co.

[57] ABSTRACT

A stepped shaft is rough-formed at a single work station by means of separate sets of rolls operating sequentially to rough-form shaft portions of different diameters. A first set of rolls operates to reduce the diameter of the entire workpiece to approximately the desired major diameter of the finished stepped shaft. Other sets of rolls operate to further reduce the diameters of selected portions of the shaft. In preferred practice the workpiece is pre-heated to a suitable work temperature and the entire rolling sequence is carried out rapidly to produce a rough-formed stepped shaft which will require a minimum of further machining.

20 Claims, 9 Drawing Figures

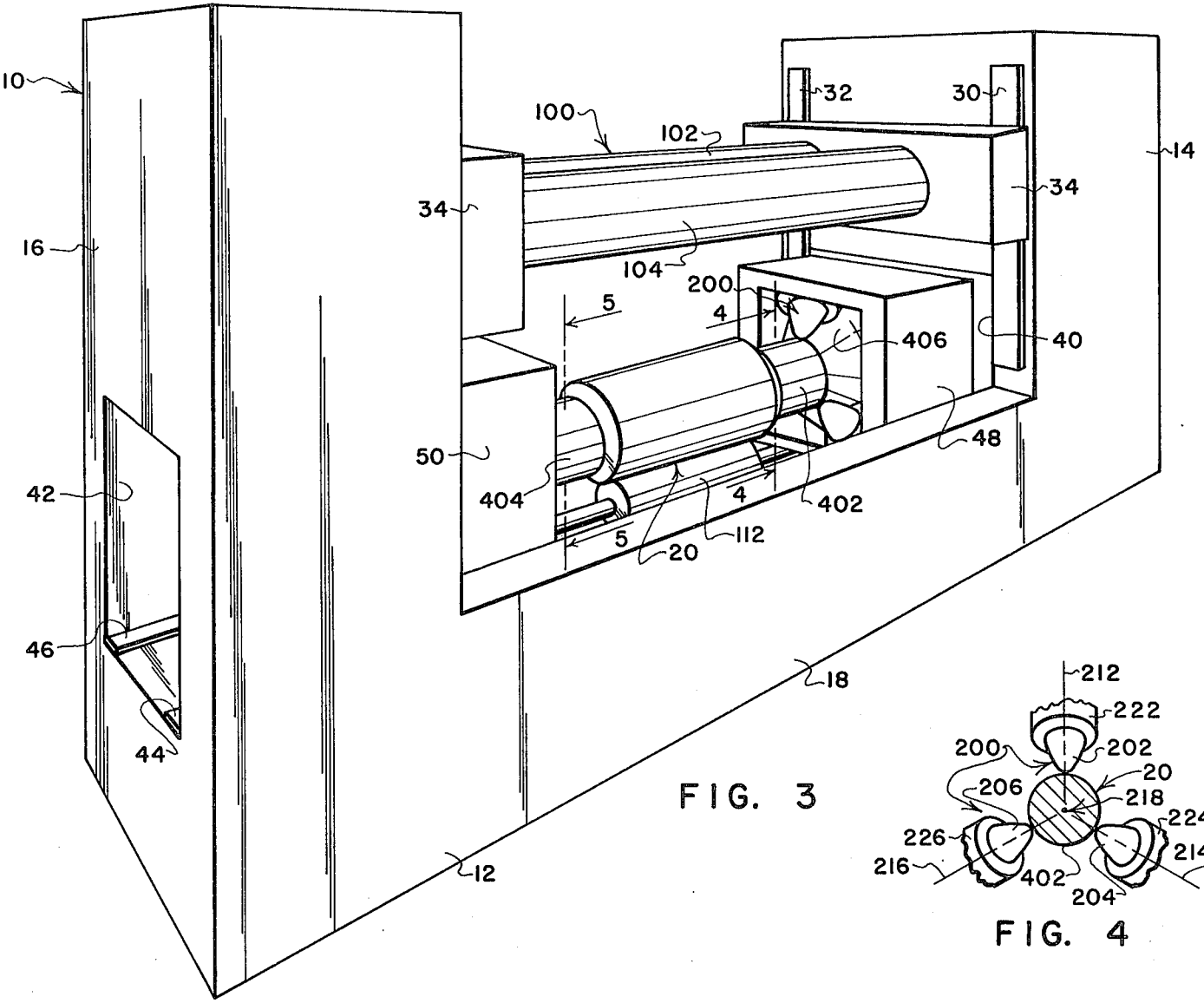
FIG. 3
FIG. 4
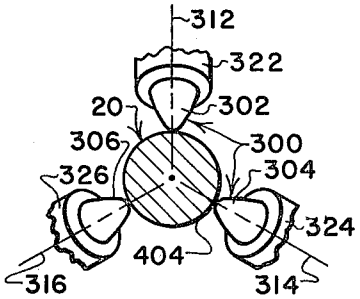
FIG. 5

ROLLING OF STEPPED SHAFTS

BACKGROUND OF THE INVENTION

1. Field of the Invention

The present invention relates generally to the production of stepped shafts and more particularly, to a novel and improved method and apparatus for rolling an elongate solid metal member to rough-form a stepped shaft.

2. Prior Art

The term "stepped shaft" refers to an elongate shaft having at least two adjacent outer surface portions of different diameters separated by a substantially radially extending shoulder. The outer surface portions of differing diameters share a common longitudinally extending center axis. In essence the outer surface of the shaft has a "stepped" configuration.

Stepped shafts formed from solid metal members are utilized in many different applications. Stepped shafts of relatively large size, e.g. those having a major outer diameter of about 6 inches or more, are utilized as processing rolls in strip mills, as axles for large off-the-road vehicles, and for many other purposes.

While stepped shafts of relatively small size can be produced economically through conventional machining processes, the production of stepped shafts of relatively large size is presently quite expensive. Factors tending to increase the expense associated with the fabrication of large stepped shafts include the difficulties that are encountered in handling the heavy body of metal from which the shaft is to be formed and in transferring the metal body or workpiece from one work station to another as it is worked during different stages of formation. Still another factor resulting in high fabrication cost is the significant amount of machining time required to cut away unwanted metal from the body as reduced diameter regions are formed on the workpiece.

The only technique in commercial use today for forming large stepped shafts is that of machining. Machining is carried out with a workpiece supported in a lathe and with conventional cutting tools operating on the outer surface of the workpiece. Machining progresses relatively slowly and may require many cutting tool passes to form the desired shaft configuration.

Although machining is an acceptable production technique where a small amount of material is to be removed, machining is expensive and time consuming where it must be used for the entire operation of forming a forged member into a closely toleranced stepped shaft. Often as much as 25% of the rough-formed material must be removed during machining of a large stepped shaft, and this tedious work tends to consume a great deal of machine time and operator time. Where relatively large cuts of metal are being removed by machining, significant amounts of energy are consumed and considerable cutting tool wear occurs.

Other than machining, the only viable technique for producing large stepped shafts is that of rolling. Prior to the present invention, the only known rolling technique theoretically capable of producing large stepped shafts was that of cross-rolling. In cross-rolling, as that technique has been used to date, a pair of flat plates are spaced from each other a distance sufficient to accommodate an elongate, generally cylindrical workpiece therebetween. The flat plates each carry raised wedge-shaped die surfaces for engaging the outer surface of the workpiece. The plates engage opposite sides of the workpiece and are moved in unison in opposite directions to roll the workpiece as the die surfaces clampingly engage the outer surface of the workpiece. During the back and forth movements of the plates, they are gradually pressed more closely together to cause a corresponding progressive decrease in the diameter of the workpiece surface portion engaged by the plates.

Cross-rolling has been used to form relatively small stepped shafts and other small objects such as threaded bolt blanks. The most attractive advantage of cross-rolling is that the shaft or bolt blank is formed quite rapidly, often within about 10 revolutions of the workpiece and often during a single stroke of the relatively movable flat plates. Cross-rolling is also advantageous because of its high production speeds and because the workpiece can be maintained at a high temperature throughout the rolling process.

Unfortunately, cross-rolling has several drawbacks which are difficult to overcome and which have tended to limit the application of this technique to the production of small objects of relatively simple configuration. If it is necessary to produce shafts having several steps in diameter, the raised wedge die surfaces must be of complex configuration. One problem with complex die surfaces is that they tend to inhibit necessary axial displacement of the material being machined. Moreover, complex die surface configurations may cause some portions of the material being rolled to stretch far more than it should, or to be rolled more times than it should, thereby undesirably altering the properties of the material. Still another problem which obtains with the use of complex die surfaces and cross-rolling techniques is that the dies are of fixed configuration and cannot be used to form stepped shafts of widely differing configurations.

Another, problem encountered with cross-rolling is that of "center cracking." This term refers to the formation of a cavity near the longitudinal axis of the workpiece. The cavity is believed to be caused by the extreme compression which occurs between the opposed rolling plates and by a so-called tri-axial stress system which is set up in the workpiece. The problem is so severe that some shafts produced by cross-rolling are greatly diminished in strength. In order to successfully produce even small shafts by cross-rolling, it has been found necessary to exercise very close control over the entire rolling operation, including control over the design of tooling, the selection of workpiece temperatures, and the selection of force loads to be imposed on the workpiece.

While a number of other rolling techniques are known for use in the formation of hollow members such as baseball bats and tubular articles, these techniques are not suitable for use in the formation of large stepped shafts.

SUMMARY OF THE INVENTION

The present invention overcomes the foregoing and other drawbacks of prior art proposals by providing a novel and improved rolling technique for forming stepped shafts, and a novel and improved apparatus for carrying out the method.

A significant advantage which obtains through the use of the system of the present invention is that a relatively large stepped shaft can be rough-formed from an elongate solid metal body at a single work station utilizing rolling techniques carried out by components of a single apparatus. By this arrangement, required handling of the body is minimized; the time needed to rough-form a stepped shaft is minimized; and the need for extensive machining is eliminated.

A further feature of the system of the present invention is that its rolling procedures can be carried out sufficiently rapidly to enable the entire rolling process to take advantage of a pre-heating of the workpiece. In most instances it is desirable to pre-heat the elongate solid metal body from which a stepped shaft is to be formed. The body is heated to a temperature which will facilitate the body's being worked by rolling. Once the body has been pre-heated, it is promptly and rapidly subjected to the sequence of rolling steps needed to rough-form a stepped shaft.

In accordance with the preferred practice of the present invention, the outer surface of an elongate solid metal member is engaged by a first set of rolls for rotating the member about a longitudinal axis and for compressing the outer surface of the member to form a workpiece having a rolled outer surface of a desired first diameter extending along at least a desired first length of the workpiece. The workpiece is then engaged by at least a second set of rolls for diminshing the diameter of the workpiece along such portions as are to have a diameter less than the first diameter. The second set of rolls engages the workpiece at a first predetermined location which is intermediate the opposite ends of the workpiece. The workpiece is rotated about the longitudinal axis relative to the second set of rolls while, at the same time, the rolls of the second set are moved radially inwardly toward the longitudinal axis to diminish the diameter of the workpiece near the first location to provide a shaft region of a desired second diameter. Once the desired second diameter has been achieved in the vicinity of the first location, the workpiece and the second set of rolls are moved with respect to each other in a direction paralleling the longitudinal axis. During this axial movement of the second set of rolls, relative rotation of the second set of rolls and the workpiece continues, and the axial length of the second diameter region is thereby caused to be extended along a desired second length of the workpiece.

In preferred practice, two spaced portions or regions of reduced diameter are formed on the workpiece concurrently. The second set of rolls operates as described to form one of these sections of reduced diameter. A third set of rolls operates in substantially the same manner as the second set at a location spaced from the area of operation of the second set to form the other of these two portions or regions of reduced diameter.

During the process of forming reduced diameter regions on the workpiece, workpiece material adjacent the second and third sets of rollers undergoes a plastic deformation and flows axially of the workpiece. This plastic deformation of workpiece material can be carried out in such a way that it improves the metallurgical qualities of the material, particularly the grain structure, and thus can have the advantageous effect of increasing the strength of the resultant shaft.

The method of the present invention is particularly effective in the formation of a stepped shaft which has its major diameter portion located centrally along the length of the shaft and which have its reduced diameter portions or minor diameters located nearer the ends of the shaft. Where a shaft of this preferred configuration is being formed, the entire metal body or workpiece from which the shaft is to be formed is preferably rolled to a uniform major diameter by means of the first set of rolls, whereafter the second and third sets of rolls are utilized to form the reduced diameter portions.

As will be readily apparent, reduced diameter portions of differing diameters can be formed by the second and/or third sets of rolls by causing the rolls of the second and/or third sets to move radially inwardly or outwardly as these rolls are moved axially along the workpiece.

The first set of rolls preferably takes the form of a plurality of elongate cylindrical rolls. The rolls of the first set have their axes extending in parallel relationship and are arranged to clamp the outer surface of the workpiece so that, during a rolling operation, these rolls can be moved to compress the outer surface of the workpiece and thereby reduce its diameter.

The second and third sets of rolls are preferably of tapered, blunt-nosed, essentially conical configuration. Each of the second and third sets of rolls preferably includes three rolls arranged in essentially 120 degree spaced relationship around the circumference of the workpiece. The rolls of each of the second and third sets are arranged for rotation about axes which intersect the axis of rotation of the workpiece. The axes of the rolls of the second and third set are inclined with respect to the axis of rotation of the workpiece, and the degrees of inclination of the axes of the rolls of the second and third sets are adjustable so that the metal working effects provided by the rolls of the second and third sets can be controlled.

An apparatus designed to carry out the method of the present invention includes movable carriages for mounting the rolls of the first set, a movable carriage for mounting the rolls of the second set, and still another movable carriage for mounting the rolls of the third set. Suitable ones of the rolls of each set are provided with driving mechanisms for rotating these rolls to effect workpiece rotation. The carriages which support the rolls of the second and third sets are retractable out of the path of movement of the carriages which support the rolls of the first set so that the rolls of the first set can access the entire length of the outer surface of the workpiece for an initial rolling operation. The carriages which support the rolls of the first set are retractable as needed to permit the rolls of the second set to engage the workpiece to effect the formation of reduced diameter portions thereon.

As will be appreciated, the method and apparatus of the present invention permit large stepped shafts to be formed at high rates of production wherein the initial high forging temperatures of workpieces may be utilized. Stepped shafts of very large size can be produced without incurring such prior art drawbacks as center cracking, extensive machining expense, the introduction of shaft weaknesses, and the like.

The apparatus of the present invention is not limited in its use to the production of stepped shafts of a particular size or configuration but rather can be utilized to produce very differently configured shafts without requiring any change in tooling. This degree of versatility is unique in the art, as is a system which permits large stepped shafts to be efficiently and economically rough-formed at a single work station.

The foregoing advantages and a fuller understanding of the invention described and claimed in the present application may be had by referring to the following description and claims taken in conjunction with the accompanying drawings.

BRIEF DESCRIPTION OF THE DRAWINGS

FIG. 3 is a perspective view of the apparatus of FIG. 1, the apparatus being shown with certain of the rolls of the first set retracted and with the workpiece being acted upon concurrently by second and third sets of rolls;

FIGS. 4 and 5 are sectional views as seen from planes indicated generally by lines 5—5 and 6—6 in FIG. 3;

DESCRIPTION OF THE PREFERRED EMBODIMENT

Figure 1:
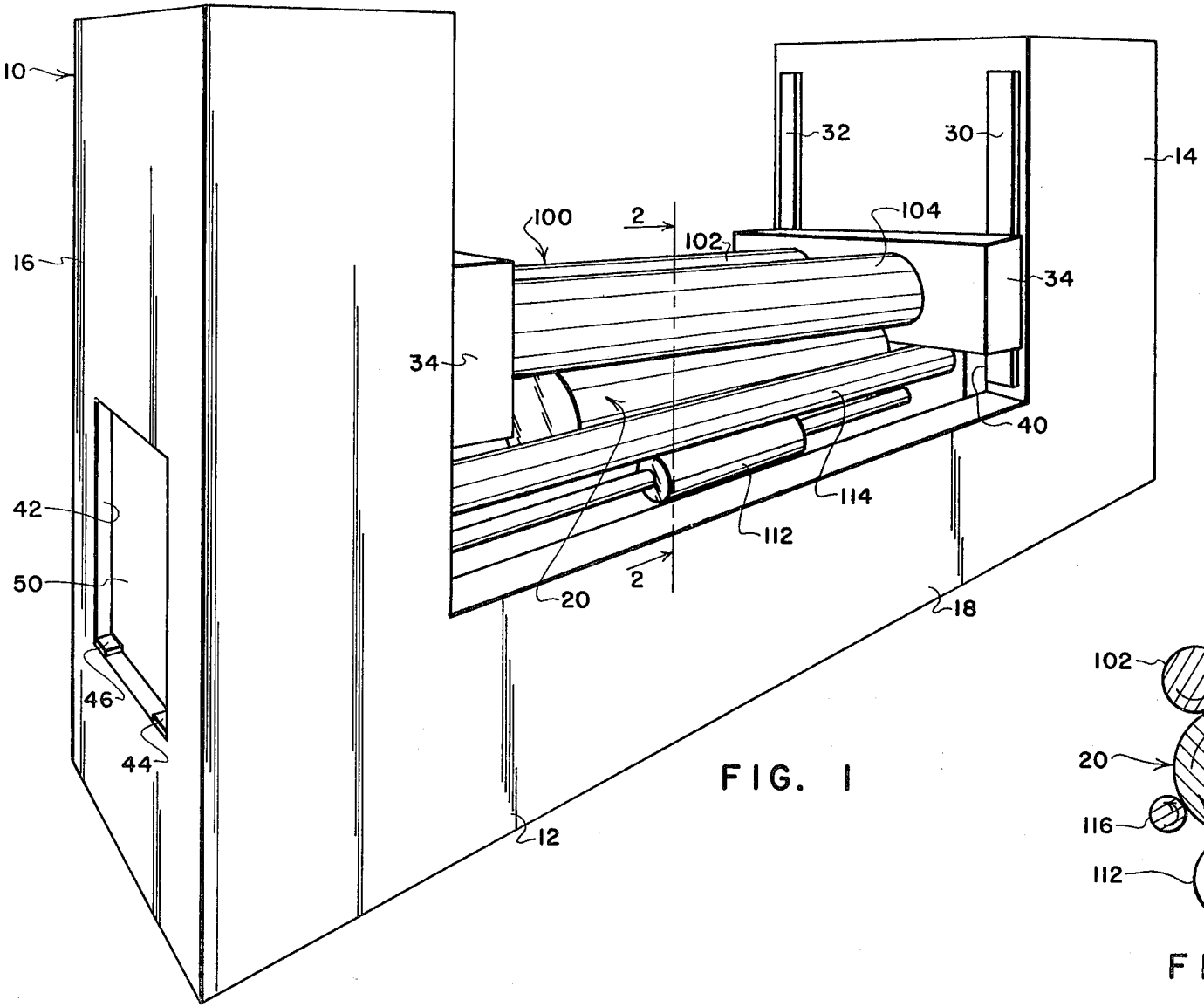
FIG. 1 is a perspective view of an apparatus suitable for carrying out the method of the present invention, the apparatus being shown with a workpiece in the process of being acted upon by a first set of rolls.

Referring to FIGS. 1–5, an apparatus for forming stepped shafts is indicated generally by the numeral 10. The apparatus 10 includes a supporting framework 12 including a pair of upstanding end structures 14, 16 interconnected by a transversely extending bed structure 18.

Three sets of forming rolls 100, 200, 300 are movably supported on the framework 12. As will be explained in greater detail, these rolls are supported on movable carriages for positioning relative to an elongate workpiece, indicated generally by the numeral 20. As will also be explained, drive systems are provided in selected ones of the roll positioning carriages for rotating selected ones of the forming rolls.

The framework end structures 14, 16 are of substantially identical construction, each forming a mirror image of the other. Each of the structures 14, 16 provides a pair of spaced, vertically extending ways 30, 32 and each has a carriage 34 mounted for vertical movement along its associated ways 30, 32. Each of the structures 14, 16 houses a suitable drive system (not shown) for positioning its associated carriage 34 along its associated ways 30, 32. Inasmuch as suitable carriage positioning drive systems are well known, the details of such conventional systems need not be described here.

The framework end structures 14, 16 are provided with aligned through passages 40, 42. A pair of ways 44, 46 extend along opposite sides of the bed structure 18 and into the passages 40, 42. A pair of carriages 48, 50 are mounted for movement along the ways 44, 46. The carriage 48 movably supports the rolls 200 and is retractable into the passage 40. The carriage 50 movably supports the rolls 300 and is retractable into the passage 42. Suitable carriage drive systems (not shown) are housed within the framework 12 for positioning the carriages 48, 50 along the ways 44, 46.

The first set of rolls 100 includes a pair of upper pressure rolls 102, 104, a lower king roll 112, and a pair of lower pressure rolls 114, 116. The upper rolls 102, 104 have their ends journaled by the carriages 34 for vertical movement therewith. The lower rolls 112, 114, 116 have their ends journaled by carriages (not shown) which are housed within lower portions of the framework 12. The drive systems which position the carriages 34 are operable in unison to vertically position the upper rolls 102, 104 and to maintain the axes of these rolls in horizontal attitudes. Similar coordinated drive systems (not shown) position the carriages which support the lower rolls 112, 114, 116, and maintain the axes of the lower rolls 112, 114, 116 in horizontal attitudes.

The carriages 34 preferably house suitable drive systems (not shown) for rotating the upper rolls 102, 104 in unison. In a similar fashion, a suitable drive system (not shown) is provided for rotating the lower king roll 112. Since drive systems for rotating a plurality of rolls in unison are well known, the details of such drive systems need not be described here.

Figure 2:
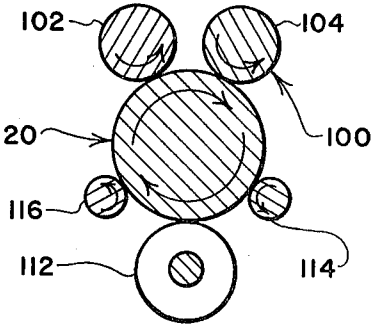
FIG. 2 is a sectional view as seen from a plane indicated generally by a line 2—2 in FIG. 1.

The lower pressure rolls 114, 116 are positioned on opposite sides of the lower king roll 112. When an elongate solid metal workpiece 20 is to be rolled to form a stepped shaft, the workpiece 20 is positioned atop the lower king rolls 112 with portions of the workpiece 20 extending into the trough formed between the two lower pressure rolls 114, 116, as is best seen in FIG. 2. Once the workpiece 20 has been so positioned, the carriages 34 are operated to move the upper rolls 102, 104 into engagement with the workpiece 20. The rolls 102, 104, 112 then rotate in unison to rotate the workpiece 20 about a longitudinal axis which parallels the axes of the rolls 102, 104, 112, 114, 116. During positioning of the workpiece 20 and during the initial rolling operation wherein the rolls 102, 104, 112, 114, 116 are utilized, the carriages 48, 50 are maintained in retracted positions within the passages 40, 42 so that neither the carriages 48, 50 nor the rolls 200, 300 interfere with vertical movement of the carriages 34.

The rolls 102, 104, 112, 114 are of elongate cylindrical configuration. The upper rolls 102, 104 have a common first diameter. The lower rolls 114, 116 have a common second diameter. The roll 112 is preferably of stepped configuration.

Alternate arrangements of rolls can, of course be used. For example, a single upper roll (not shown) which is centered over the trough defined between the bottom rolls 114, 116 can be substituted for the upper pair of rolls 102, 104.

The carriages 48, 50 are of substantially identical construction, each forming a mirror image of the other. The second and third sets of rolls 200, 300 are of substantially identical construction, each set being arranged within its associated carriage 48, 50 to form a mirror image of the other set.

Referring to FIG. 4, the second set of rolls 200 includes three rolls 202, 204, 206, each being of tapered, blunt-pointed, essentially conical configuration. The rolls 202, 204, 206 are supported for rotation about axes 212, 214, 216 which point toward and intersect the axis of rotation of the workpiece 20. The axes 212, 214, 216 intersect the workpiece rotation axis at a common point indicated by the numeral 218. The rolls 212, 214, 216 are preferably arranged at equally spaced locations around the circumference of the workpiece 20, i.e. at 120 degree spacings.

The carriage 48 includes members 222, 224, 226 which rotatably and movably support the rolls 202, 204, 206. The members 222, 224, 226 are arranged much like the jaws of a conventional three-jaw chuck and are movable in unison radially inwardly and outwardly of the axis of rotation of the workpiece 20 to selectively position the rolls 202, 204, 206. The carriage 48 may house a suitable drive system (not shown) for rotating the rolls 202, 204, 206 in unison if the lower king roll 12 is not used to drive the workpiece 20 during operation of the rolls 202, 204, 206.

Referring to FIG. 5, the third set of rolls 300 includes three rolls 302, 304, 306 which are identical to the rolls 202, 204, 206. The rolls 302, 304, 306 are supported by members 322, 324, 326 for rotation about axes 312, 314, 316 in exactly the same manner as the rolls 202, 204, 206 are supported by the members 222, 224, 226. A suitable roll drive system (not shown) may be housed within the carriage 50 for rotating the rolls 302, 304, 306 in unison.

In preferred practice, suitable orientation systems (not shown) are additionally provided within the carriages 48, 50 for adjusting the angles of inclination of the axes 212, 214, 216, 312, 314, 316 with respect to the axis of rotation of the workpiece 20 whereby different metal working effects can be obtained during operation of the rolls 200, 300. During normal operation, the axes 212, 214, 216 are all inclined at equal degrees with respect to the axis of rotation of the workpiece 20, and the axes 312, 314, 316 are likewise all inclined at equal degrees with respect to the workpiece rotation axis.

Figure 6:
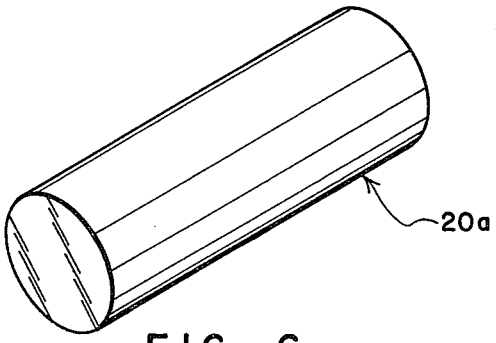
FIG. 6 is a perspective view of a solid metal member before it has been operated upon to form a stepped shaft.

The method by which an elongate solid metal member is formed into a stepped shaft in accordance with the preferred practice of the present invention is illustrated somewhat schematically in FIGS. 6–9. Referring to FIG. 6, an elongate solid metal member such as a workpiece 20*a* constitutes the starting point for the process. The member 20*a* can be quite large, on the order of 500 pounds or more. Ordinarily, the member 20*a* will have been forged to approximately a cylindrical configuration from a billet, ingot or other basic form.

Figure 7:
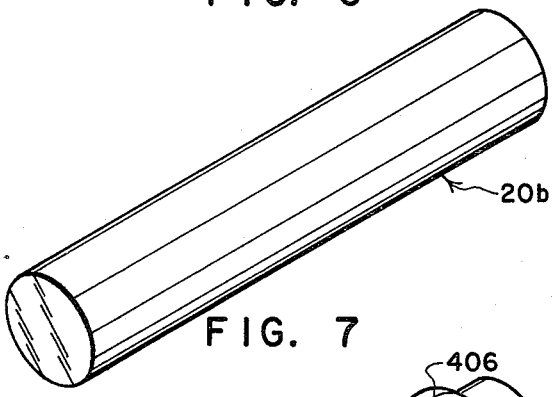
FIG. 7 is a perspective view of the member of FIG. 6 after it has been rolled to form an elongate, cylindrical workpiece having a desired uniform major diameter along its length.

The workpiece 20*a* is then rolled to provide it with a uniform outer diameter which is slightly larger than the major diameter of the stepped shaft to be formed. This rolling process can be carried out in the apparatus 10 through the use of the upper and lower rolls 102, 104, 112, 114, 116. The upper and lower sets of rolls 102, 104 and 112, 114, 116 are moved relatively toward each other during rolling engagement with the workpiece 20*a* to compress the outer surface of the workpiece 20*a* and to cause the workpiece 20*a* to elongate as may be necessary to permit the outer surface of the workpiece to diminish in diameter. The resulting elongated workpiece is indicated in FIG. 7 by the numeral 20*b*.

Once the workpiece 20*a* has been rolled to provide a uniform outer diameter which is slightly larger than the desired major diameter of the stepped shaft to be formed, the upper rolls 102, 104, are raised to the elevated position shown in FIG. 3, and one or both of the sets of rolls 200, 300 are then utilized to effect the formation of one or more regions or portions of reduced diameter. In order to effect the formation of regions or portions of reduced diameter, the rolls 200, 300 are brought into engagement with the outer surface of the workpiece 20*b* at approximately the locations where shoulders are to be provided as transitions between the area of major diameter and the reduced diameter regions or portions. The lower pressure rolls 114, 116 are lowered to a position out of engagement with the workpiece 20*b*, and the lower king roll 112 preferably remains in driving engagement with the workpiece 20*b* to effect its rotation.

The rolls 200, 300 rotate in unison with the workpiece 20*b*. During this rotation, the rolls 200, 300 are moved substantially radially inwardly to effect reductions in diameter of the workpiece 20*b* in the vicinities of the locations where shoulders are to be provided on the workpiece. Once the rolls 200, 300 have been moved inwardly to effect the formation of a desired lesser diameter or diameters in the vicinities of shoulder locations (the rolls 200 may be utilized to form a different lesser diameter than the rolls 300 or vice versa), retraction movements of the carriages 48, 50 toward the openings 40, 42 are begun. The condition of the workpiece at this stage is illustrated in FIG. 8, wherein the workpiece is designated by the numeral 20*c*.

Figure 8:
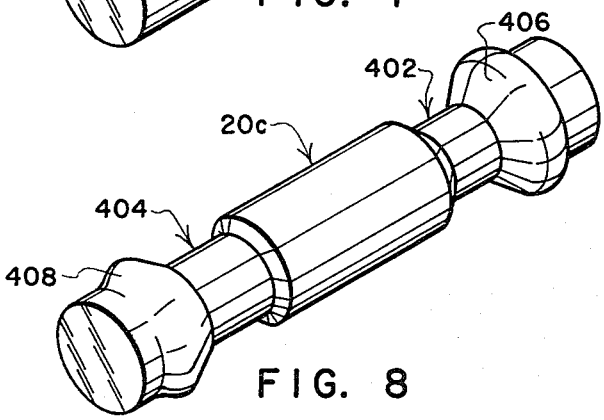
FIG. 8 is a perspective view of the workpiece of FIG. 7 during the time when the workpiece is being operated upon by the second and third sets of rolls; and, FIG. 9 is a perspective view of a stepped shaft produced by extending the minor diameters of the workpiece of FIG. 8 to the ends of the workpiece.

Referring to FIG. 8, as rolling continues and as retraction movements of the carriages 48, 50 continue, regions or portions 402, 404 of reduced diameter are caused to be extended axially along the workpiece 20*c*. The material of the workpiece 20*c* in regions adjacent the rolls 200, 300 undergoes plastic deformation. As the rolls 200, 300 move axially to extend the reduced diameter regions or portions 402, 404, "bubbles" of material 406, 408 of a diameter greater than that of the rolled workpiece 20*b* tend to form behind the rolls 200, 300. As the carriages 48, 50 continue to retract, the "bubbles" 406, 408 continue to move axially along the workpiece 20*c* toward its opposite ends.

Figure 9:
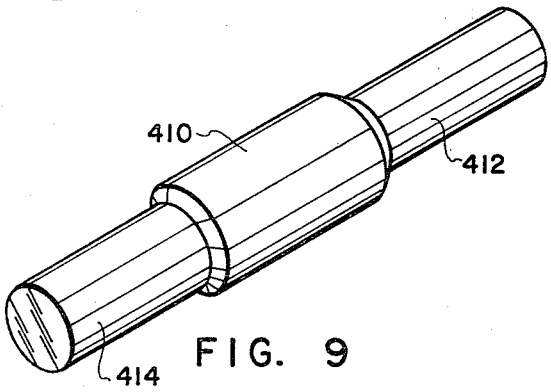

If desired, the rolls 200, 300 may be retracted the entire length of the workpiece 20*c*, in which case, a stepped shaft 20*d* having a central portion of a major diameter 410 and end portions of minor diameters 412, 414, will be produced, as illustrated in FIG. 9. Alternatively, the rolls 200, 300 may be caused to operate only within a selected range of movement where reduced diameter shaft portions are to be formed. Moreover, the rolls 200, 300 can be moved radially inwardly or outwardly as the carriages 48, 50 retract to effect the formation of shaft portions of other desired reduced diameters, whereby shafts having a relatively large number of different diameter portions or regions can be formed. Where required, the lower pressure rolls 114, 116 may be raised to assist in supporting the workpiece as the rolls 200, 300 complete their work.

In preferred practice, when the rolls 200, 300 are moved radially inwardly to initiate the formation of reduced diameter portions or regions 402, 404, the rolls 200, 300 are also moved slightly concurrently axially as by retraction movements of the carriages 48, 50. This somewhat complex movement of the rolls 200, 300 is substantially radial in character with respect to the axis of rotation of the workpiece, but is sufficiently non-radial to assure that the "bubbles" 406, 408 form principally behind the rolls 200, 300 rather than in front of these rolls.

A feature of the system of the present invention is that it enables stepped shafts to be rough formed at essentially a single work station without reduced diameter portions of the shafts having to be machined to any great degree. The system of the present invention is not utilized to form the final precise diameters of a stepped shaft but rather is utilized to eliminate the majority of the machining that would otherwise be required to produce reduced diameter shaft portions. A further feature of the invention lies in the speed and ease with which a relatively large stepped shaft can be configured very closely to its final form.

In most instances, the workpiece from which a stepped shaft will be formed is first pre-heated to a temperature which will facilitate its being formed by rolling. A separate pre-heating step may not be required if the workpiece has just been hot forged and has maintained an adequate temperature. Once the workpiece has been heated to a suitable temperature, it is quickly positioned atop the lower rolls 112, 114, 116. The upper rolls 102, 104 are quickly lowered into position so that the rolling of the major diameter of the shaft can be carried out. The reduced diameter portions of the shaft are then quickly rolled through the described operation of the rolls 200, 300. No external handling or reheating of the workpiece is ordinarily required from the time the workpiece is positioned atop the rolls 112, 114, 116 until a stepped shaft having slightly over-sized diameters is formed.

Once a stepped shaft having slightly over-sized diameters has been formed, it is removed from the apparatus 10, is treated for desired hardness, and is machined using conventional machining techniques to remove such metal as must be removed to conform the stepped shaft to its desired final diameters. The speed and ease and economies with which a stepped shaft having approximately the desired diameters can be formed utilizing the system of the present invention compare extremely favorably with prior art procedures which would require extensive machining to arrive at the same result.

Although the invention has been described in its preferred form with a certain degree of particuliarity, it is understood that the present disclosure of the preferred form has been made only by way of example and that numerous changes may be resorted to without departing from the spirit and scope of the invention as hereinafter claimed. It is intended that the patent shall cover, by suitable expression in the appended claims, whatever features of patentable novelty exist in the invention disclosed.

I claim:

1. A method of forming a stepped shaft from a solid metal member having a longitudinal axis extending substantially centrally through the member between opposite ends thereof, comprising the steps of:

(a) engaging the outer surface of the member with a first set of roll means for rotating the member about the longitudinal axis and for compressing the outer surface of the member to form a workpiece having a rolled outer surface of a desired first diameter extending along at least a desired first length of the workpiece;

(b) engaging the workpiece with a second set of roll means at a first predetermined location intermediate the opposite ends of the workpiece and rotating the workpiece about the longitudinal axis relative to the second set of roll means while, at the same time, moving the second set of roll means substantially radially inwardly toward the longitudinal axis to diminish the diameter of the workpiece near such first location to provide a shaft region of a desired second diameter; and (c) moving the workpiece and the second set of roll means with respect to each other in a direction paralleling the longitudinal axis while continuing to rotate the workpiece relative to the second set of roll means, thereby extending the axial length of the second diameter region along a desired second length of the workpiece.

2. The method of claim 1, wherein:

(a) prior to the member being engaged by the first set of roll means, the member is pre-heated to a suitable temperature to facilitate its being worked by rolling; and (b) the rolling steps employing the first and second sets of roll means are conducted sufficiently rapidly to take advantage of the pre-heating of the member.

3. The method of claim 1, comprising the additional steps of:

(a) engaging the workpiece with a third set of roll means at a second predetermined location intermediate the opposite ends of the workpiece, the second location being spaced from the first location and being external of the region of second diameter, and rotating the workpiece about the longitudinal axis relative to the third set of roll means while, at the same time, moving the third set of roll means substantially radially inwardly toward the longitudinal axis to diminish the diameter of the workpiece near such second location to provide a shaft portion of a desired third diameter; and, (b) moving the workpiece and the third set of roll means with respect to each other in a direction paralleling the longitudinal axis while continuing to rotate the workpiece relative to the third set of roll means, thereby extending the axial length of the third diameter portion along a desired third length of the workpiece.

4. The method of claim 3 wherein the second and third sets of roll means comprise sets of substantially conically-shaped rolls adapted to engage the workpiece in the vicinities of the pointed ends of the conically-shaped rolls.

5. The method of claim 3 wherein:

(a) the second and third set of roll means operate on the workpiece concurrently; and (b) the first and second locations are arranged such that the second and third sets of roll means move away from each other toward opposite ends of the workpiece during the extension of the second diameter region and the third diameter portion.

6. A method of forming spaced reduced diameter portions on a generally cylindrically shaped workpiece, comprising the steps of:

(a) engaging the workpiece with a first set of roll means at a first location;

(b) engaging the workpiece with a second set of roll means at a second location spaced from the first location;

(c) rotating the workpiece with respect to the first and second sets of roll means;

(d) moving the first and second sets of roll means radially inwardly toward the longitudinal axis of the workpiece while continuing relative rotation between the workpiece and the roll means, thereby decreasing the diameter of the workpiece in the vicinities of the first and second locations;

(e) stopping the radially inward movement of the first and second sets of roll means when desired first and second minor diameters have been attained in the vicinities of the first and second locations; and, (f) moving the first and second sets of roll means relatively away from each other and relatively away from the first and second locations along the longitudinal axis of the workpiece while continuing rotation of the workpiece with respect to the roll means, thereby extending the first and second minor diameters along desired lengths of the workpiece.

7. The method of claim 6, wherein the first and second sets of roll means each comprise a plurality of substantially conically-shaped rolls arranged at equidistantly spaced locations about the circumference of the workpiece.

8. The method of claim 6 wherein:

(a) prior to the workpiece being engaged by the first and second sets of roll means, the workpiece is pre-heated to a suitable temperature to facilitate its being worked by rolling; and (b) the rolling steps employing the first and second sets of roll means are conducted sufficiently rapidly to take advantage of the pre-heating of the workpiece.

9. The method of claim 6 wherein:

(a) prior to the workpiece being engaged by the first and second sets of roll means, the workpiece is engaged by an initial set of roll means for rolling the workpiece to reduce its outer diameter to a desired major diameter; and (b) the rolling steps involving the initial set of roll means, the first set of roll means and the second set of roll means are carried out at a common work station.

10. A method of forming a stepped shaft from a solid member having a longitudinal axis extending substantially centrally through the member between its opposite ends, comprising the steps of:

(a) providing an apparatus defining a single work station and having first, second and third sets of roll means for engaging the outer surface of an elongate solid metal member for rolling the member about a longitudinal axis and for compressing selected portions of the member to form a stepped shaft;

(b) engaging the outer surface of the member with the first set of roll means for rotating the member about the longitudinal axis and for compressing the outer surface of the member to form a workpiece having a rolled outer surface of a desired first diameter extending along at least a desired first length of the workpiece;

(c) engaging the workpiece with a second set of roll means at a first predetermined location intermediate the opposite ends of the workpiece and rotating the workpiece about the longitudinal axis relative to the second set of roll means while, at the same time, moving the second set of roll means substantially radially inwardly toward the longitudinal axis to diminish the diameter of the workpiece near such first location to provide a shaft region of a desired second diameter;

(d) engaging the workpiece with a third set of roll means at a second predetermined location intermediate the opposite ends of the workpiece, the second location being spaced from the first location, and rotating the workpiece about the longitudinal axis relative to the third set of roll means while, at the same time, moving the third set of roll means substantially radially inwardly toward the longitudinal axis to diminish the diameter of the workpiece near such second location to provide a shaft portion of a desired third diameter;

(e) moving the workpiece and the second set of roll means with respect to each other in a direction paralleling the longitudinal axis while continuing to rotate the workpiece relative to the second set of roll means, thereby extending the axial length of the second diameter region along a desired second length of the workpiece; and, (f) moving the workpiece and the third set of roll means with respect to each other in a direction paralleling the longitudinal axis while continuing to rotate the workpiece relative to the third set of roll means, thereby extending the axial length of the third diameter portion along a desired third length of the workpiece.

11. The method of claim 10 wherein:

(a) the steps of engaging the workpiece with the second set of roll means and with the third set of roll means are conducted substantially concurrently; and, (b) the steps of extending the axial lengths of the second and third diameter region and portion are conducted substantially concurrently with the region and portion being extended in opposite directions along the length of the workpiece.

12. The method of claim 10 wherein:

(a) prior to the member being engaged by the first set of roll means, the member is pre-heated to a suitable temperature to facilitate its being worked by rolling; and, (b) the rolling steps employing the first, second and third sets of roll means are conducted sufficiently rapidly to take advantage of the pre-heating of the member.

13. An apparatus for forming an elongate solid metal member into a stepped shaft, comprising:

(a) a plurality of elongate first rolls having their center axes disposed substantially parallel to each other, and being adapted to receive an elongate solid metal member therebetween with a longitudinal axis of the member paralleling the center axes of the first rolls;

(b) means for moving the first rolls into engagement with the outer surface of the member;

(c) means for rotating the member and the first rolls relative to each other while continuing the engagement between the first rolls and the outer surface of the member for rolling the member into an elongate, cylindrical workpiece;

(d) a plurality of second adapted to engage the workpiece at a location intermediate the ends of the workpiece, the second rolls being spaced equidistantly about the circumference of the workpiece;

(e) means for rotating the workpiece and the second rolls relative to each other;

(f) means for moving the second rolls radially inwardly toward the longitudinal axis of the workpiece while continuing relative rotation between the workpiece and the second rolls for diminishing the diameter of a portion of the workpiece to a desired first minor diameter; and, (g) means for moving the workpiece and the second rolls with respect to each other axially of the workpiece while continuing relative rotation between the workpiece and the second rolls for extending the first minor diameter axially of the workpiece.

14. The apparatus of claim 13 additionally including:

(a) a plurality of third rolls adapted to engage the workpiece at a second location spaced from the first location, the third rolls being spaced equidistantly about the circumference of the workpiece;

(b) means for rotating the workpiece and the third rolls relative to each other;

(c) means for moving the third rolls radially inwardly toward the longitudinal axis of the workpiece while continuing relative rotation between the workpiece and the third rolls for diminishing the diameter of a region of the workpiece to a desired second minor diameter; and, (d) means for moving the workpiece and the third rolls with respect to each other axially of the workpiece while continuing relative rotation between the workpiece and the third rolls for extending the second minor diameter axially of the workpiece.

15. An apparatus for forming a stepped shaft by rolling an elongate solid metal member, comprising:

(a) a first set of roll means for rotating the member about a longitudinal axis and for compressing the outer surface of the member to form a workpiece having a rolled outer surface of a desired first diameter extending along at least a desired first length of the workpiece;

(b) first carriage means for rotatably supporting the first set of roll means;

(c) support means for supporting the first carriage means and, hence, the first set of roll means for movement toward and away from the member;

(d) a second set of roll means for engaging the workpiece at a first predetermined location intermediate the ends of the workpiece and for compressing the outer surface of the workpiece to form a shaft region of a desired second diameter;

(e) second carriage means for rotatably supporting the second set of roll means to permit relative rotation with respect to the workpiece, and for movably supporting the second set of roll means to permit radial inward and outward movement with respect to the longitudinal axis of the workpiece; and, (f) the support means also being operable to support the second carriage means for movably positioning the second carriage means and, hence, the second set of roll means axially of the metal member.

16. The apparatus of claim 15, wherein:

(a) the first carriage means is movable in a plane extending substantially perpendicular to the longitudinal axis; and, (b) the second carriage means is movable in a plane extending substantially parallel to the longitudinal axis.

17. The apparatus of claim 16, wherein:

(a) the first carriage means is movable vertically; and, (b) the second carriage means is movable horizontally.

18. The apparatus of claim 15, further comprising:

(a) a third set of roll means for engaging the workpiece at a second predetermined location intermediate the ends of the workpiece and for compressing the outer surface of the workpiece to form a shaft region of a desired third diameter;

(b) third carriage means for rotatably supporting the third set of roll means to permit relative rotation with respect to the workpiece, and for movably supporting the third set of roll means to permit radial inward and outward movement with respect to the longitudinal axis of the workpiece; and, (c) the support means also being operable to support the third carriage means for movably positioning the third carriage means and, hence, the third set of roll means axially of the metal member.

19. The apparatus of claim 18, wherein:

(a) the first carriage means is movable in a plane extending substantially perpendicular to the longitudinal axis; and, (b) the second and third carriage means are movable in planes extending substantially parallel to the longitudinal axis.

20. The apparatus of claim 19, wherein:

(a) the first carriage means is movable vertically; and (b) the second and third carriage means are movable horizontally.

* * * * *